United States Patent [19]

Johnson et al.

[11] Patent Number: 4,542,545

[45] Date of Patent: Sep. 24, 1985

[54] BATHTUB WITH FOOTWELL AND ENTRANCE DOOR

[76] Inventors: Richard L. Johnson, 1936 Elm St., White Bear Lake, Minn. 55110; Carl J. Johnson, 2086 N. 1st St., North St. Paul, Minn. 55109

[21] Appl. No.: 588,519

[22] Filed: Mar. 12, 1984

[51] Int. Cl.[4] ..... A47K 3/18

[52] U.S. Cl. ..... 4/555; 4/556; 4/557; 206/818; 220/230; 277/80

[58] Field of Search ..... 4/556, 538, 555, 557, 4/558, 559; 277/80; 220/230; 206/818

[56] References Cited

U.S. PATENT DOCUMENTS

| | | | |
|---|---|---|---|
| 2,456,275 | 12/1948 | Harris | 4/556 |
| 2,471,634 | 5/1949 | Mark et al. | 206/818 X |
| 2,471,635 | 5/1949 | Mark et al. | 206/818 X |
| 2,991,482 | 7/1961 | Brass | 4/556 |
| 3,066,316 | 12/1962 | Russell | 4/556 |
| 3,213,335 | 10/1965 | Bourne et al. | 206/818 X |
| 3,371,354 | 3/1968 | Hayslett | 4/556 |
| 3,719,960 | 3/1973 | Russell | 4/556 |

FOREIGN PATENT DOCUMENTS

| | | | |
|---|---|---|---|
| 294295 | 4/1965 | Netherlands | 277/80 |

*Primary Examiner*—Henry K. Artis

[57] ABSTRACT

A generally rectangular open topped vessel with vertical walls around the periphery of a floor consisting of two integrally formed levels, the lower level being at one end providing a footwell and having a drain therein. Near the end of one side wall, in the area where the footwell is located, is a door opening. This door opening has a ferromagnetic faced door stop around the edge. A door is hingedly attached to the edge of the opening such that it swings horizontally inward towards the nearest adjacent end wall. The door has a flange along its two vertical edges and along its bottom horizontal edge. Mounted concentrically on the flange are two magnetic gaskets such that when the door is closed the gakets force a water tight seal with the ferromagnetic plate on the door stop. A second drain is located in the surface of the bottom door stop such that when the door is closed water in the vessel cannot reach the drain due to the sealing of the outer gasket. With the door open water will go down this drain before it reaches the door opening.

4 Claims, 7 Drawing Figures

BATHTUB WITH FOOTWELL AND ENTRANCE DOOR

FIELD OF INVENTION

This invention relates to a bathtub that is easily accessible, safe, and comfortable for everyone, especially those with physical disabilities.

DISCUSSION OF PRIOR ART

Heretofore, many forms of bathtubs have been designed for use by the physically disabled. Most can be described as a deep tub having a seat and also a door allowing ease of entry and exit. Various types of door closures and latching mechanisms are used to realize a watertight seal. All types of door closure and latching mechanisms used have disadvantages. Some use a door which slides vertically and must be fully removed by lifting it upward. These are difficult to operate, especially by a physically disabled person. Another type is a door that swings outward about a vertical axis. This type has an inherent water sealing problem. A third type decreases this problem by swinging inwardly using the head pressure of the water in the tub, pushing outward on the door, to assist in sealing the door. However, this type uses a complicated and expensive latch mechanism to hold the door closed. This latch mechanism requires strength and manual dexterity to operate, both being attributes that many physically disabled persons do not possess. It also has several moving parts which make it subject to wear and breakdown. Subsequent repair would be expensive and inconvenient.

OBJECTS

Accordingly several objects of this invention are;

- a mechanism for holding the door closed that can be operated easily by everyone including the physically disabled.
- a mechanism for holding the door closed and sealed that is inexpensive to produce because it is made of readily available parts.
- a mechanism for holding the door closed that has no moving parts giving long life and requiring no periodic lubricating.
- a drain to prevent water overflow in the event that the door is inadvertently left open with the water running.

Further objects and advantages of the invention will become apparent from a consideration of the drawings and ensuing description thereof.

DRAWINGS

DESCRIPTION

Figure 1:
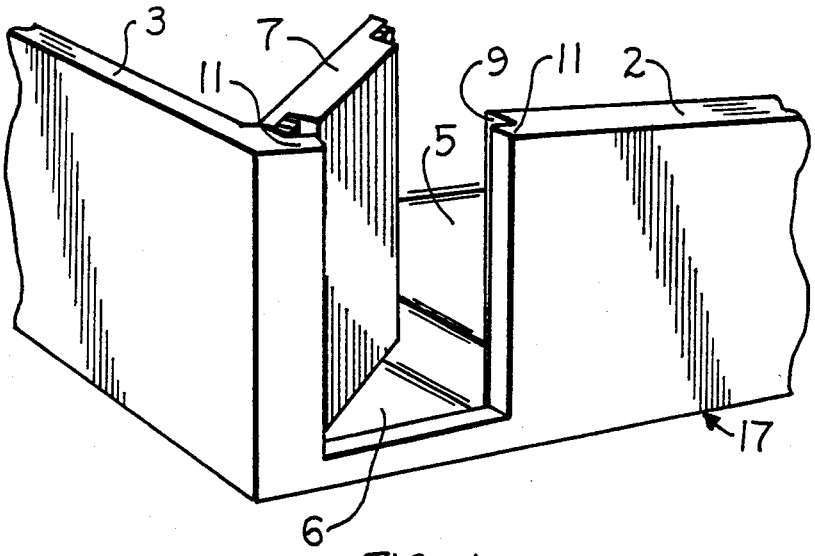
FIG. 1 is a partial perspective view of the tub as seen from the exterior with the door in a partially open position.
Figure 2:
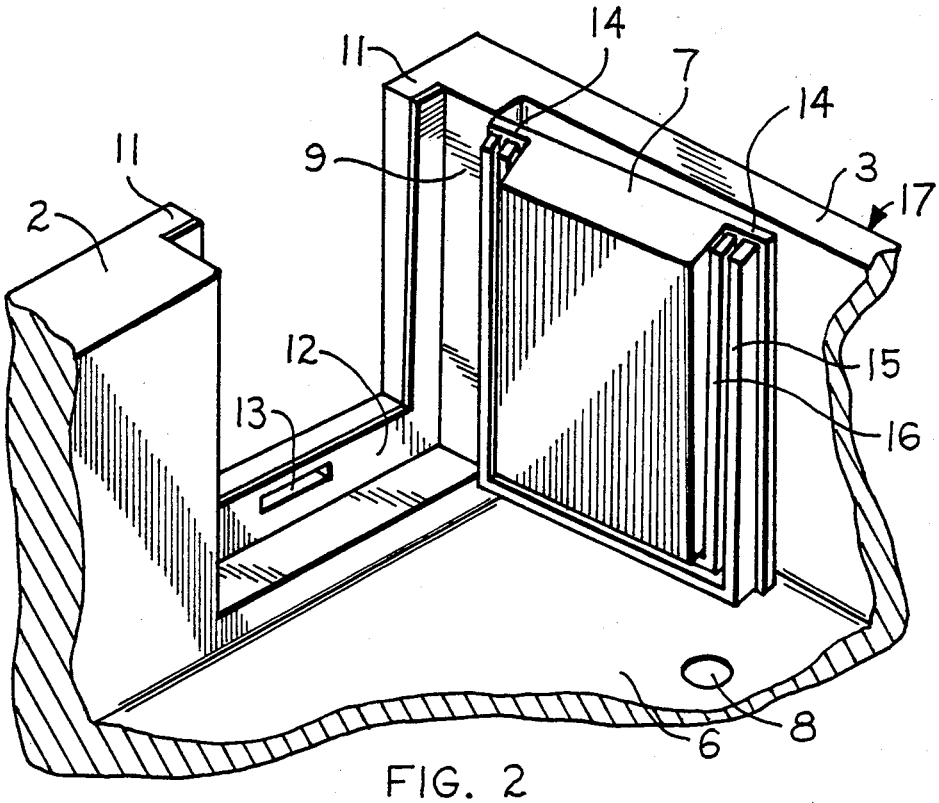
FIG. 2 is a partial perspective view of the tub as seen from the interior with the door in a fully open position.
Figure 3:
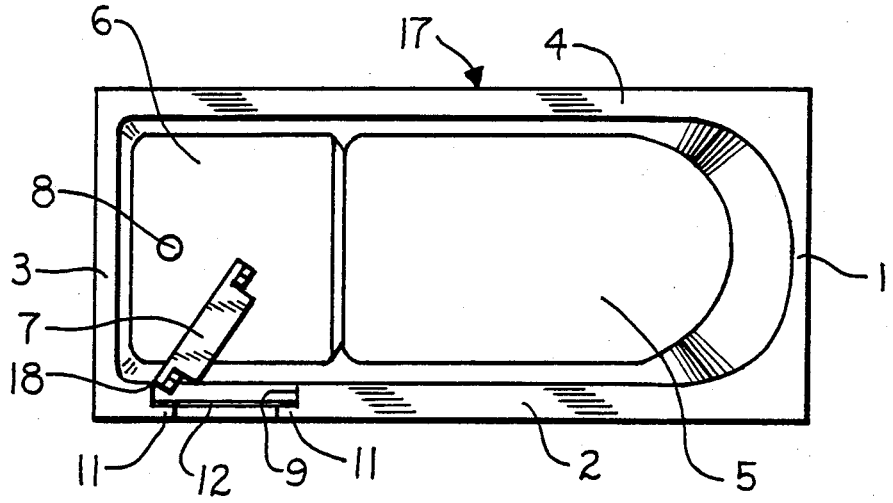
FIG. 3 is a top plan view of the tub with the door in a partially open position.

Referring specifically to the drawings, numeral 17 designates the overall bathtub of the invention. The bathtub consists of a horizontal floor 5 and 6 with four vertical walls, 1,2,3, and 4 extending upward from the periphery of the aforementioned floor 5 and 6. The floor 5 and 6 is generally rectangular in plan with two integrally formed horizontal levels, a lower level 6 and an upper level 5. The lower level of the floor 6 includes a closable drain opening 8. Side wall 2 has a door opening 9 near the end having the lower floor level 6. The door opening 9 has a door stop 11 around the perimeter. This door stop 11 is made of a ferromagnetic material or is faced on the inside surface with a ferromagnetic plate 12. A drain opening 13 is located in the face of the bottom horizontal door stop. Its exact location will be described later. This drain opening 13 has a suitable connection with the opening 8 and with the disposal system.

There is a horizontally swinging door 7 asssociated with the aforementioned opening 9. The door 7 is hingedly supported with hinges 18 by the vertical margin of the door opening 9 in the wall 2 and from the side nearest the adjacent wall 3. The door 7 is shaped to fit the opening 9, having a flange 14 on both vertical edges and along the bottom horizontal edge. Two magnetic gaskets 15 and 16, made of a magnetic strip within resiliently compressible material, are mounted concentrically on said door flange 14.

The aforementioned door drain 13, located in the bottom horizontal door stop of the door opening 9 must be located such that with the door 7 closed, the outer gasket 15 makes a seal below the drain 13, and the inner gasket 16 seals above the drain 13.

OPERATION

The door is shaped to fit the opening and is hinged such that it can be opened wide providing easy entry and exit. When closed it gives a watertight seal. The mechanism used to hold the door closed and to make a watertight seal is magnetism. The magnetic gasket is an available resiliently compressible gasket with an embedded magnetic strip. The magnetic attraction between the magnetic strip of the door mounted gasket and the ferromagnetic plate on, or ferromagnetic material of, the door stop is what holds the door closed. It also provides a compressing force on the sandwiched resilient material making a watertight seal. In operation, as the tub fills the head pressure of the water increases the force on the door assisting the magnetic strip with its closure and sealing function. When the door is not closed tightly the drain below the door opening is not covered allowing water to go down the drain before reaching the opening. With the door closed the outer gasket keeps water from reaching the drain, therefore, the tub can be filled. The inner gasket provides additional holding and sealing force as well as preventing water from backing up through the door drain when the tub is being emptied.

Figure 4:
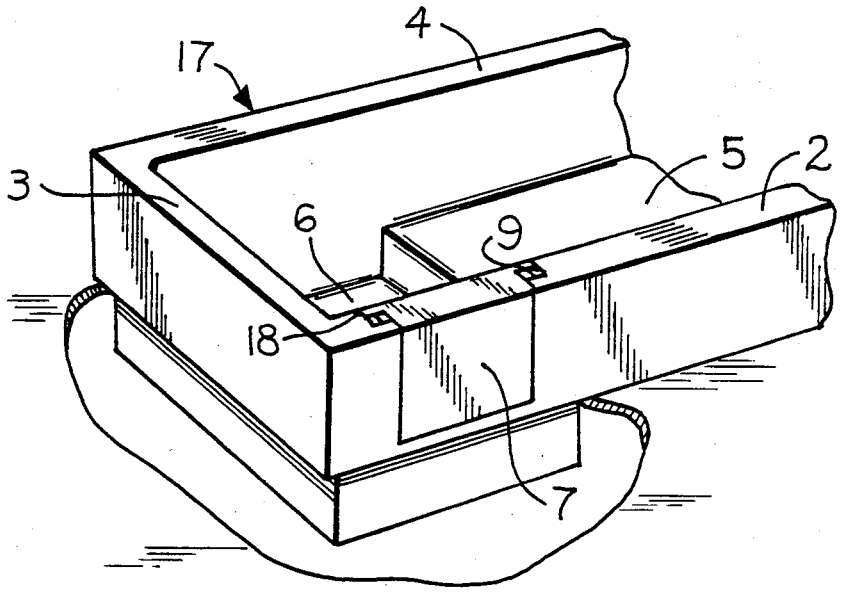
FIG. 4 is a partial perspective view of an alternative tub structure, on a partially cut away supporting surface.
Figure 5:
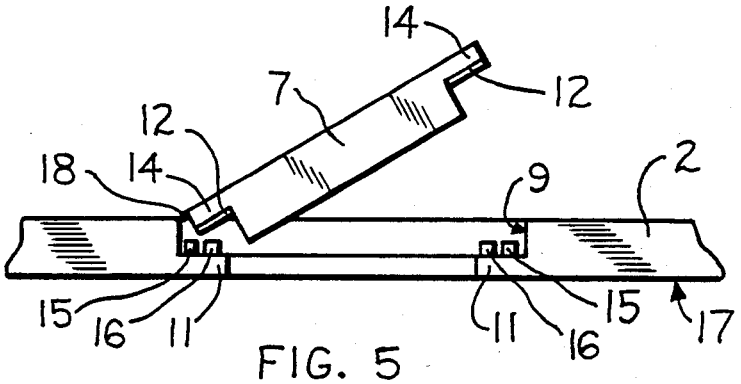
FIG. 5 is a partial top plan view of the door opening and door showing a variation of magnetic gasket and ferromagnetic surface combination.
Figure 6:
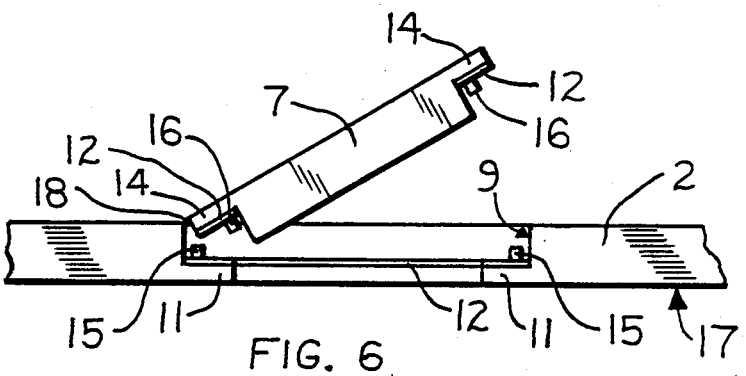
FIG. 6 is a partial top plan view of the door opening and door showing a variation of magnetic gasket and ferromagnetic surface combination.
Figure 7:
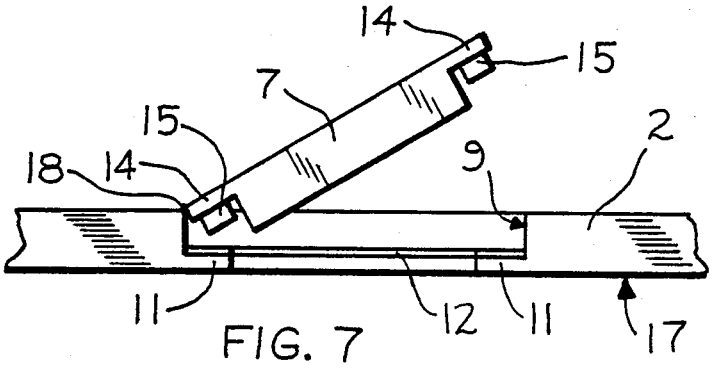
FIG. 7 is a partial top plan view of the door opening and door showing a variation of magnetic gasket and ferromagnetic surface combination.

While this description is quite specific, it should not be construed as limitations on the scope of the invention, but rather as an example of one preferred embodiment. Many other variations are possible, for example;

it may be constructed as a right hand tub.

the location of the magnetic gaskets and the ferromagnetic plate may be swapped, that is, the gaskets mounted on the door stop and the ferromagnetic plate on the door flange.

magnetic gaskets may be mounted on both the door stop and door flange such that they would seal with a plate on the door flange and door stop, respectively.

replacement of the double gasket structure by a single gasket of sufficient width to cover the drain would provide additional sealing area as well as facilitate installation on the flange.

the tub may be constructed such that the footwell would be sunk into the supporting floor giving a more streamlined appearance without changing the benefits. See FIG. 4.

Accordingly, the scope of the invention should be determined not by the embodiment illustrated, but by the appended claims and their legal equivalents.

We claim:

1. A water-tight, open-topped bathtub receptacle having a plurality of vertical side walls, a bottom and a major drain opening, and having in one vertical wall a doorway with a hingedly attached unitary inwardly opening door, a compressible continuous magnetic gasket and a cooperating ferromagnetic surface at cooperating margins of said door and doorway respectively, and an auxiliary drain outlet located in said wall at the bottom of said doorway and so disposed as to be sealed from the inside of said receptacle by said gasket while said door is in the closed position.

2. The water-tight, open-topped bathtub of claim 1 wherein said compressible continuous magnetic gasket comprises an inner gasket and an outer gasket concentrically mounted on said door whereby the outer gasket makes a seal below said auxiliary drain outlet and said inner gasket makes a seal above said auxiliary drain outlet.

3. The water-tight, open-topped bathtub of claim 2 wherein said compressible continuous magnetic gaskets are located on said doorway and the cooperating ferromagnetic surface is concentrically located on and about said door.

4. The water-tight, open-topped bathtub of claim 2 wherein one gasket is concentrically mounted on and about said door relatively to said door and the other gasket is concentrically mounted on and about said doorway and said cooperating ferromagnetic surface is located on said door and said doorway.

* * * * *